United States Patent [19]

Odermann

[11] 4,214,542

[45] Jul. 29, 1980

[54] LOW BOBBIN THREAD DETECTION SYSTEM INCLUDING PHOTODETECTOR HOLDER SHIELDED WITH PLASTIC LENS

[75] Inventor: Charles R. Odermann, Montville, N.J.

[73] Assignee: The Singer Company, Stamford, Conn.

[21] Appl. No.: 45,539

[22] Filed: Jun. 4, 1979

[51] Int. Cl.[2] ..... B65H 63/02

[52] U.S. Cl. ..... 112/278

[58] Field of Search ..... 112/278, 273, 262.1; 350/96.1, 96.34; 200/61.18

[56] References Cited

U.S. PATENT DOCUMENTS

| | | | |
|---|---|---|---|
| 3,599,586 | 8/1971 | Newman | 112/278 |
| 3,738,296 | 6/1973 | Mackenzie et al. | 112/273 |

*Primary Examiner*—H. Hampton Hunter

*Attorney, Agent, or Firm*—William V. Ebs; Robert E. Smith; Edward L. Bell

[57] ABSTRACT

A holder containing the light detector of the low bobbin thread detection system of a sewing machine and including a light admitting aperture through which light may pass to a photodetector is provided with a plastic tubular collar which extends over the aperture and serves both as a shield to keep lint out of the aperture and as a lens to focus light on a light sensitive surface in the photodetector.

9 Claims, 8 Drawing Figures

Fig.1
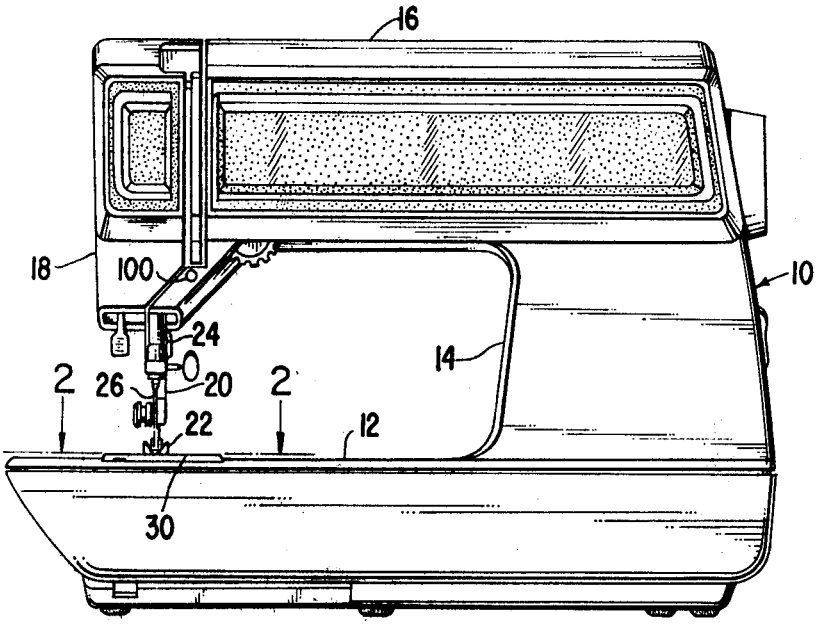
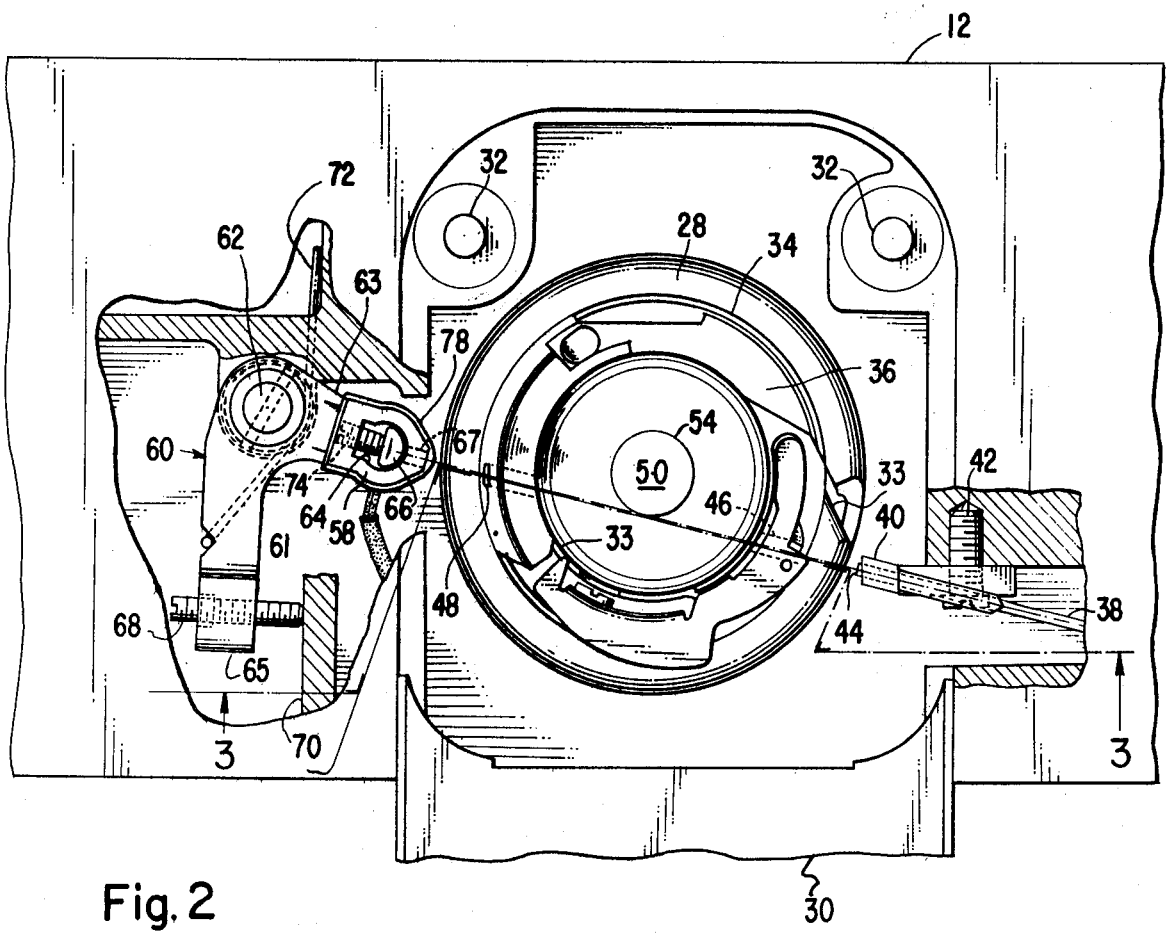
Fig. 2

Fig.3
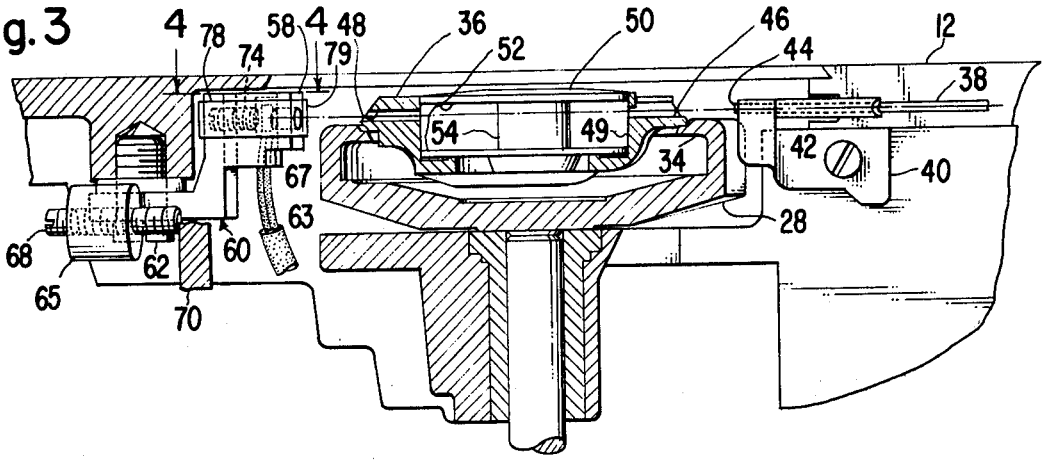
Fig.4
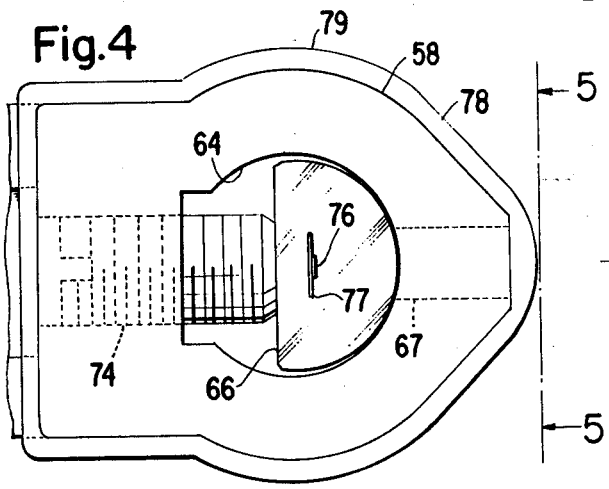
Fig.5
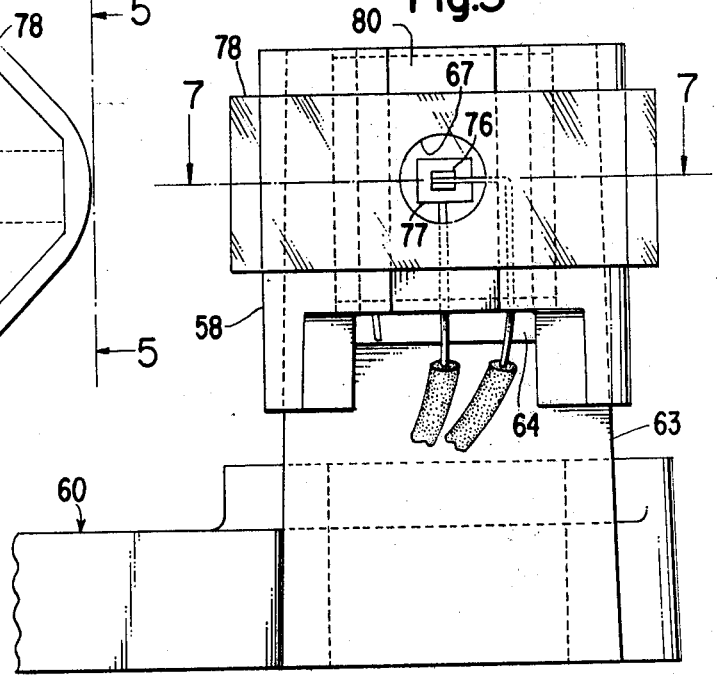
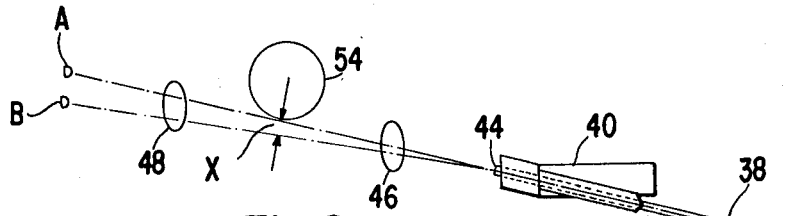
Fig.6

LOW BOBBIN THREAD DETECTION SYSTEM INCLUDING PHOTODETECTOR HOLDER SHIELDED WITH PLASTIC LENS

BACKGROUND OF THE INVENTION

1. Field of the Invention

The invention relates to low bobbin thread detection systems for a sewing machine.

2. Description of the Prior Art

It is well known to provide a sewing machine with a low bobbin thread detection system including a light source on one side of a loop taker to project light rays along a path in close proximity to the hub of a bobbin, and further including a photodetector on the other side of the loop taker to detect light rays from the light source when thread on the bobbin is about to be depleted and thereupon initiate the operation of a signaling device to warn the machine operator of the impending exhaustion of the bobbin thread. A system of the described type is disclosed in the copending application by K. D. Adams for "Adjustable Bobbin Thread Run-Out Indicator", Ser. No. 916,614, filed June 19, 1978 and assigned to The Singer Company. In such systems, a photodetector is disposed in a holder, and an aperture provided in the holder to permit light rays generated by the light source to enter the holder and fall upon the photodetector. Unfortunately, however, lint tends to accumulate in the aperture and adversely affect the operating reliability of the low bobbin thread detection system. The reliability is also deleteriously affected by external light such as may pass, for example, through a bobbing thread window, and thence through the aperture to impinge upon the photodetector.

It is an object of this invention to provide an optical shield over the aperture of the photodetector holder of a low bobbin detector system of the kind described to prevent the accumulation of lint in the aperture, and it is a further object to have such shield focus light from the system's light source upon the photodetector to thereby increase the signal to noise ratio due to light generated by said source and to external light respectively so as to enable the design of a system of greater reliability than would otherwise be possible.

SUMMARY OF THE INVENTION

In accordance with the invention, the photodetector holder of a low bobbin detection system is provided with a plastic collar of optical quality which is cut from a length of tubing and disposed on the holder to cover an aperture in the holder through which light from the light source of the system must pass before falling on the photodetector. The collar is stretched over the holder and is shaped thereby opposite the aperture in the form of a plano-convex lens having its focal point at the location of the light sensitive surface of the detector. The collar serves a dual purpose in that it prevents the accumulation of lint within the light admitting aperture in the holder, and increases the intensity of light reaching the light sensitive surface of the photodetector from the system's light source.

DESCRIPTION OF THE DRAWINGS

FIG. 1 is a front elevational view of a sewing machine including a low bobbin thread detection system wherein a photodetector holder is provided with a plastic lens shield according to the invention.

FIG. 2 is a view taken substantially on the line 2—2 of FIG. 1 showing in plan a portion of the bed of the machine, partially broken away and from which certain components have been removed in order to show said low bobbin detection system including the photodetector holder, and also the lens shield of the invention;

FIG. 3 is a sectional view taken substantially on the plane of the line 3—3 of FIG. 2;

FIG. 4 is an enlarged fragmentary view taken on the plane of the line 4—4 of FIG. 3;

FIG. 5 is an end view of the photodetector holder taken on the plane of the line 5—5 of FIG. 4;

FIG. 6 is a diagram related to FIG. 2 and showing the variability in initiation of a bobbin thread indication possible by shifting the photodetector holder;

DESCRIPTION OF THE PREFERRED EMBODIMENT

Figure 7:
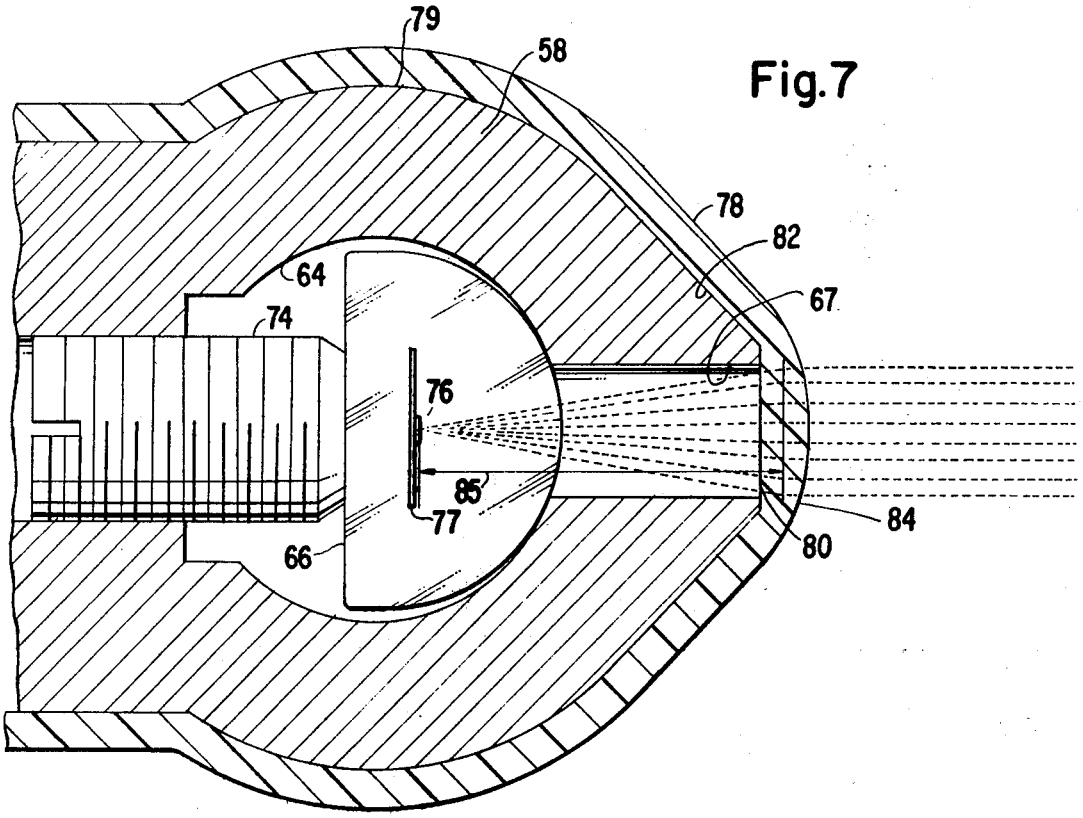
FIG. 7 is a much enlarged fragmentary view taken on the plane of the line 7—7 of FIG. 5 and illustrating the path of light to a light sensitive surface of the photodetector.

Referring to FIG.1 of the drawings, reference character 10 designates a sewing machine according to the invention including bed 12 from end of which rises a standard 14. The standard 14 supports an arm 16 in overhanging relationship to the bed 12 and the arm terminating in a head end portion 18. Within the head end portion 18 there is supported in the usual fashion for sewing machines a presser bar 20 terminating in a presser foot 22 for urging work material against feed dogs (not shown) in the bed 12 of the machine. Also supported in the head end portion 18 for endwise reciprocation as is well known in the sewing machine art is a needle bar 24 terminating in a sewing needle 26, in such a fashion that the sewing needle will cooperate with a rotating loop taker 28 (see FIG. 2) supported in the bed 12. Not shown in FIG. 1 is the feed system and feed dogs supported in the bed 12 which, intermittent to penetration of the work material by the sewing needle 26, urges the work material in a selected direction forward or reverse. Also not shown is the actuating means for causing endwise reciprocation of the needle bar 24, and for causing rotation of the loop taker 28 as well as driving the feed system. There is appparent in FIG. 1 the bed slide 30 which normally covers the rotating loop taker 28 while providing support for the work material.

Referring now to FIG. 2 there is shown in plan that portion of the bed 12 within which is supported the rotating loop taker 28. The bed slide 30 has been slid out of the way to expose the rotating loop taker 28 to view, and the throat plate (not shown) normally retained by magents 32 has also been removed. Portions of the bed 12 have also been broken away so that the invention may be seen in greater detail. The rotating loop taker 28 is formed inwardly so that a slot therethrough will form a hook point 33. The uppermost edge of the rotary loop taker 28 is formed with a rabbet 34 so as to provide support for the extended ledge of a bobbin case 36 (see FIG. 3). As may be apparent from an inspection of FIG. 3 the bobbin case 36 is carried primarily within the rotating loop taker 28, but there is a portion which extends therefrom. The upper surface of the bobbin case 36 supports thereon thread handling components to provide bobbin thread tension and thread guidance. For more information on this specific form of rotating loop taker, bobbin case and bobbin arrangement disclosed herein the reader is referred to U.S. Pat. No. 3,693,566, issued on Sep. 26, 1972 to S. J. Ketterer, which is assigned to the same assignee as the present application, and is hereby incorporated by reference herein.

Referring to FIGS. 2 and 3 there is shown a fibre optic 38 held by a support 40 which is attached to the sewing machine frame by screw 42. Light from a light source (not shown) is picked up by the fibre optic 38 and transferred by the fibre optic to the end 44 thereof, which end then operates as a light source itself. That portion of the bobbin case 36 extending from the rotating loop taker 28 is fashioned with openings 46, 48 in substantial alignment with the fibre optic 38. The bobbin case 36 is fashioned with a cavity 49, which cavity receives a bobbin 50 having an upper and lower flanges 52 joined by a hub 54. The fibre optic 38 and openings 46, 48 in the bobbin case 36 are situated with respect to each other and to the bobbin 50 so as to be substantially tangential to the hub 54 of the bobbin.

Arranged in the bed 12 of the sewing machine 10 on that side of the rotating hook 28 opposite the fibre optic 38 there is a photodetector holder 58 which is shown as an integral part of a bent lever 60. The bent lever 60 is supported in the bed 12 of the sewing machine 10 on a shoulder screw 62 extending through the bent lever at the bend thereof and fastened to the sewing machine frame. A first leg 63 of the bent lever 60 extends from the pivot screw 62 in the direction of the rotating loop taker 28 to holder 58 which carries within a through cavity 64 in substantial alignment with the axis of the first lever, a photodetector 66. The photodetector may take the form of a light sensitive photodiode or phototransistor. A light ray transmitted from the end 44 of the fibre optic 38 will pass through the openings 46, 48 in the bobbin case 36, and through an aperture 67 in the tip of holder 58 to the photodetector 66 within the cavity 64. The second leg 61 of the bent lever 60 also extends from the pivot screw 62, and is fashioned at the end thereof with a boss 65 which is threaded to accept an adjusting screw 68 substantially transverse to the second leg. The adjusting screw 68 impinges upon a rib 70 of the bed 12. A biasing spring 72 urges the bent lever 60 in a direction to maintain the adjusting screw 68 in constant contact with the rib 70 of the bed 12. As may be seen in FIG. 4, the photodetector 66 is affixed within cavity 64 in the holder 58 with a set screw 74. During assembly of the holder 58 and photodetector 66, the photodetector is moved into through cavity 64 and secured in place with the screw 74 when the light sensitive surface 76 on a plate 77 of the photodetector is suitably aligned, as indicated in FIG. 5, with aperture 67.

Referring to FIG. 6, the effect of rotation of the bent lever 60 around the pivot screw 62 by means of the adjusting screw 68 may be demonstrated. The letters A and B represent the two extreme positions of the active area of photodetector 66 achieved by turning screw 68 from one extreme position to the other. As explained above, the fibre optic 38 has an end 44 thereof which operates as a light source. Light rays from the end 44 of the fibre optic 38 extend through the openings 46, 48 in the bobbing case 36, which openings are oval in shape to accommodate the adjustment capability contemplated. When the photodetector 66 is positioned by the screw 68 so that its active area is located in the position A shown in FIG. 4 is easy to see from the position of the light ray with respect to the hub 54 of the bobbin that no thread may remain on the hub without impeding the passage of the light ray to the sensor which is necessary for initiation of a low bobbin indication. If however the photodetector 66 is positioned so that its active area is located as shown at B in FIG. 6 it will be understood that an indication of a low bobbin thread condition will not be initiated until there is less than "X" thickness of bobbin thread on the hub 54 of the bobbin 50, which would allow light to pass. Adjustment for a low bobbin indication with a thread supply on the hub 54 of less than "X" thickness may be accommodated by rotation of the adjusting screw 68 to position the active area of light sensor 66 somewhere between the positions A and B shown in FIG. 6.

As shown, holder 58 is provided with a plastic tubular collar 78 to keep lint out ot the aperture 67 and to serve as a lens to focus light from light source 44 upon the light sensitive surface 76 of the photodetector. The collar is preferably cut from a length of polyurethane tubing of uniform thickness which is of optical quality and then tightly stretched over outer surface 79 of the holder 58 to extend in front of aperture 67 and form a tight frictional bond with said surface. Surface 79 includes a planar rectangularly shaped area 80 at the tip of the holder including aperture 67, and the surface diverges from the area 80 as shown. When collar 78 is stretched over holder 58, the inside surface of the collar is caused to conform at 82 to the flat area 80 at the tip of the holder, and the opposite outside surface of the collar is caused at 84 to assume a convex curvature to thereby provide a plano-convex lens in front of aperture 67 as best seen in FIG. 7. The configuration of the holder 58 and thickness of the tubing from which the collar 78 is formed are selected to provide a focal length 85 for the plano-convex lens such as to focus light from the light source upon the light sensitive surface 76 of the photodetector.

Figure 8:
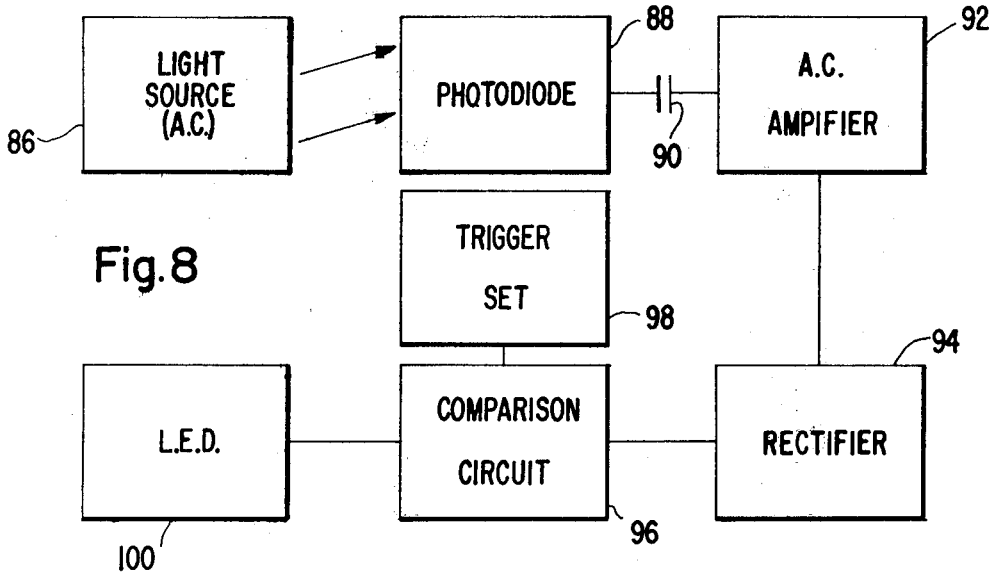
FIG. 8 is a block diagram of the electronics for the bobbin thread detection system.

Referring to FIG. 8, there is shown a block circuit diagram of a low bobbin thread detection system including a light source 86 operating from an AC source, or more preferably, from a pulsating DC source obtained by half wave rectification of an AC source, and including a Darlington photodiode 88. An output from the photodiode passes through a capacitance 90 which is provided to block the DC output from the photodiode in order to eliminate dark currents as a source of low bobbin signal. Thus the photodiode responds to the variation in the light source 86 caused by the pulsating DC source. The resulting alternating current passed by the capacitance 90 is amplified in an AC amplifier 92. After amplification, the AC current is rectified in rectifier 94 and the resulting signal is compared by a comparison circuit 96 to a value adjusted by trigger set 98. The comparison circuit 96 includes therein, ideally, and operational amplifier having positive feedback in order to latch a valid indication once achieved into a permanent signal. The output on the comparison circuit 96 is then fed to a LED 100 which is visible to the eye of the operator and may be seen in FIG. 1. The indication may be implemented preferably by a blinking light from the LED 100,which is thereby made apparent to an operator.

While only a particular preferred embodiment of the invention has been shown and described by way of illustration, many modifications will occur to those skilled in the art, and it is therefor to be understood that it is intended to cover all such modifications as fall within the true spirit and scope of the invention.

I claim

1. In a low bobbin thread detection system for a sewing machine including a light source, a photodetector to receive light from said source when bobbin thread is about to be depleted, and a warning device operable by the photodetector, the combination comprising a holder in which the photodetector is situated and which has an aperture therein to permit light from the light source to pass to the photodetector, and a plastic collar on the holder extending over the aperture and shaped opposite the aperture as a lens to focus light from the light source on the photodetector.

2. The combination of claim 1 wherein the plastic collar is shaped as a plano-convex lens opposite the aperture.

3. The combination of claim 1 wherein the plastic collar is stretched over the holder and shaped thereby as a lens opposite the aperture.

4. The combination of claim 3 wherein the collar is formed from a section of cylindrical tubing of uniform thickness.

5. The combination of claim 4 wherein the holder includes a planar surface with the aperture extending therethrough, and the stretched collar extends across the planar surface and around a portion of the holder to form a plano-convex lens opposite the aperture.

6. The combination of claim 1 wherein the lens has a focal point at a light sensitive surface in the photodetector.

7. The combination of claim 1 wherein the collar is stretched over the holder and a tight frictional bond is thereby established between collar and holder.

8. The combination of claim 1 wherein the collar is formed from a section of polyurethane tubing.

9. The method of forming a lens over the light admitting aperture of the photodetector holder of a low bobbin detector system for a sewing machine comprising the steps of forming a planar surface on the holder to include the aperture, forming a collar from plastic tubing of uniform cross-section, and stretching said collar around a portion of the holder including the planar surface to form a plano-convex lens opposite the aperture.

* * * * *